United States Patent [19]

Tamba et al.

[11] Patent Number: 4,697,557

[45] Date of Patent: Oct. 6, 1987

[54] V-TYPE INTERNAL COMBUSTION ENGINE

[75] Inventors: Shinichi Tamba; Noriyuki Ueki, both of Kakogawa, Japan

[73] Assignee: Kawasaki Jukogyo Kabushiki Kaisha, Kobe, Japan

[21] Appl. No.: 875,213

[22] Filed: Jun. 17, 1986

[30] Foreign Application Priority Data

Jun. 18, 1985 [JP] Japan ..... 60-132732
Jun. 18, 1985 [JP] Japan ..... 60-132733

[51] Int. Cl.[4] ..... F02D 31/00

[52] U.S. Cl. ..... 123/319; 123/52 MV; 123/195 P; 123/402; 123/363

[58] Field of Search ..... 123/52 MV, 196 W, 195 P, 123/319, 363, 344, 364, 332, 376, 402, 373, 55 VF, 55 VE, 55 V, 55 VS

[56] References Cited

U.S. PATENT DOCUMENTS 4,513,702 4/1985 Koga et al. ..... 123/196 W
4,515,120 5/1985 Amemori et al. ..... 123/195 P
4,570,587 2/1986 Watanabe et al. ..... 123/196 W

FOREIGN PATENT DOCUMENTS 53-31158 3/1978 Japan .
57-2652 1/1982 Japan .

*Primary Examiner*—Craig R. Feinberg
*Assistant Examiner*—David A. Okonsky
*Attorney, Agent, or Firm*—Leydig, Voit & Mayer

[57] ABSTRACT

A V-type internal combustion engine in which cylinders each including a cylinder skirt portion projecting into a crankcase are arranged in a V-shape, a governor device is disposed within the crankcase, central axes of the cylinders are offset from each other in an axial direction along a crankshaft supported in the crankcase, and a rotational speed transmission system for transmitting a rotational speed of a governor gear to a governor lever shaft is engages a rearward side of the cylinder skirt portion of a cylinder spaced forward from a rearward most cylinder as viewed among the crankshaft central axis. A single intake manifold is adapted to bridge cylinder heads in a V-bank defined between the cylinders. A carbureter is in fluid communication with the intake manifold. One end of the governor lever shaft is disposed in the V-bank. An intake control for controlling the carbureter in cooperation with one end of the lever shaft is disposed in the vicinity of the carbureter.

8 Claims, 3 Drawing Figures

V-TYPE INTERNAL COMBUSTION ENGINE

BACKGROUND OF THE INVENTION

The present invention relates a V-type internal combustion engine and more particularly to a governor device for such a V-type internal combustion engine in which cylinders are arranged in a V-shape and are offset from each other in an axial direction of a crankshaft.

For example, in a single cylinder engine, since a carbureter is disposed on one side of the engine, a governor device may be arranged in a space below the carbureter, thus utilizing the limited space. However, in case of the V-type internal combustion engine, generally an intake manifold is arranged to bridge cylinders of the cylinder bank, and a carbureter is disposed in a midpoint of the intake manifold. Therefore, the V-type engine is subjected to various limitations in mounting the governor device.

Such a V-type internal combustion engine in which cylinders are arranged in a V-shape is shown in, for example, Japanese Utility Model Laid-Open No. 31158/78. In this V-type engine, a crank gear is provided on a crankshaft, and a governor gear is adapted to operate in cooperation with the crank gear. In the governor device shown in that publication, a gear case portion extends from and unitary with one side of a crankcase, and the governor gear is disposed within the gear case.

With such an arrangement, the length thereof in the axial direction of the crankshaft becomes large, and makes the engine as a whole large in size. In addition, since the governor chamber must be formed independently, the structure of the crankcase becomes complicated. In association with this, the number of mechanical parts must be increased.

SUMMARY OF THE INVENTION

In view of the above-noted drawbacks, an object of the present invention is to make the engine compact, while simplifying the structure and decreasing the number of the mechanical parts.

In order to attain this and other objects, according to the invention, there is provided a V-type internal combustion engine in which cylinders each having a cylinder skirt portion project into a crankcase are arranged in a V-shape, center axes of the cylinders are offset from each other in an axial direction of a crankshaft supported in the crankcase, and a rotational speed transmission system for transmitting a rotational speed of a governor gear to a governor lever shaft is provided on one side of the cylinder skirt portion of one, of the cylinders, offset toward a rear side as viewed from the outside in the axial direction of the crankshaft.

DESCRIPTION OF THE PREFERRED EMBODIMENT

The present invention will now be described with reference to the accompanying drawings.

Figure 1:
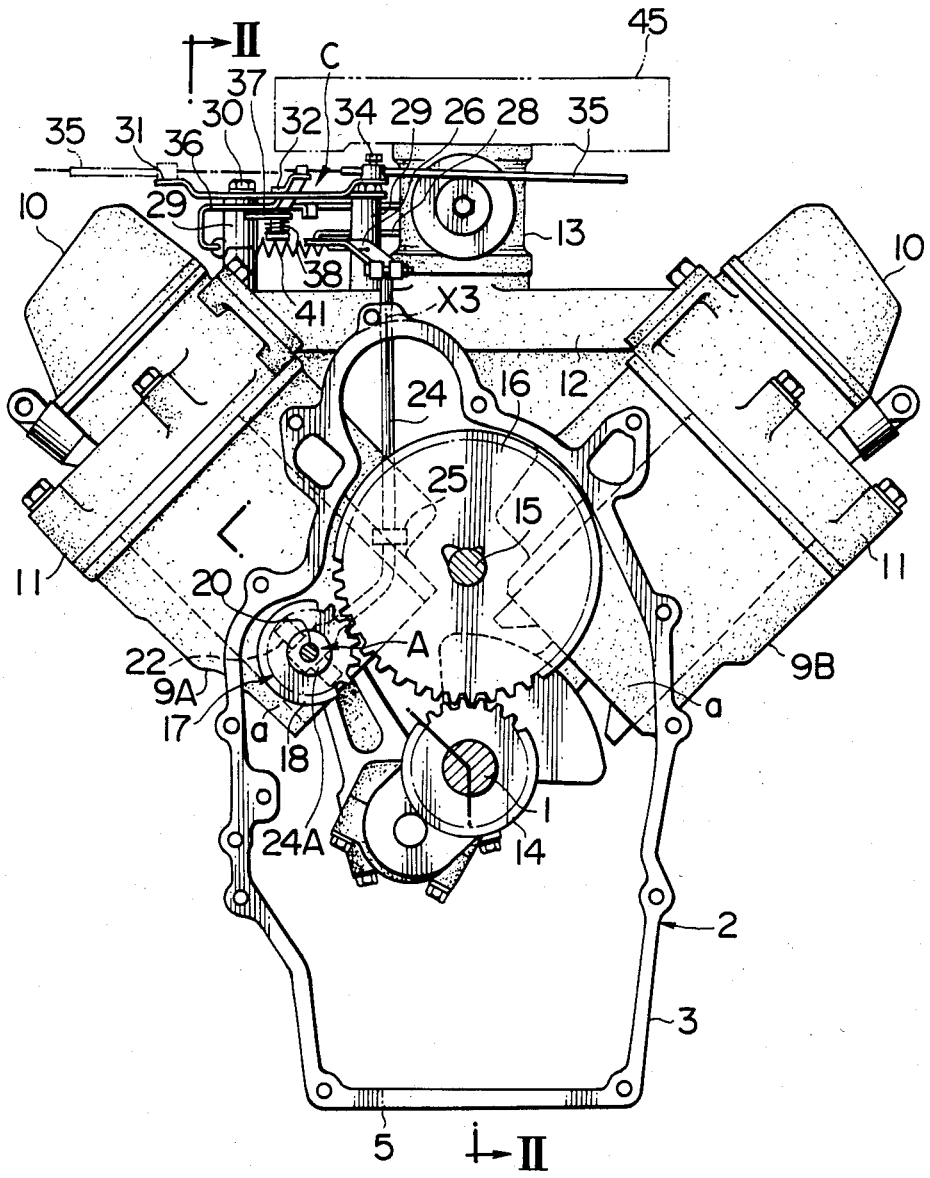
FIG. 1 is a cross-sectional view, taken along the line I—I of FIG. 2, of a V-type internal combustion engine in accordance with one embodiment of the invention.

FIG. 1 shows a vertically mounted, air cooling V-type internal combustion engine whose crankshaft 1 vertically extends with respect to the engine mount surface. In this case, the upper portion of the engine is shown by U in FIG. 2.

Figure 2:
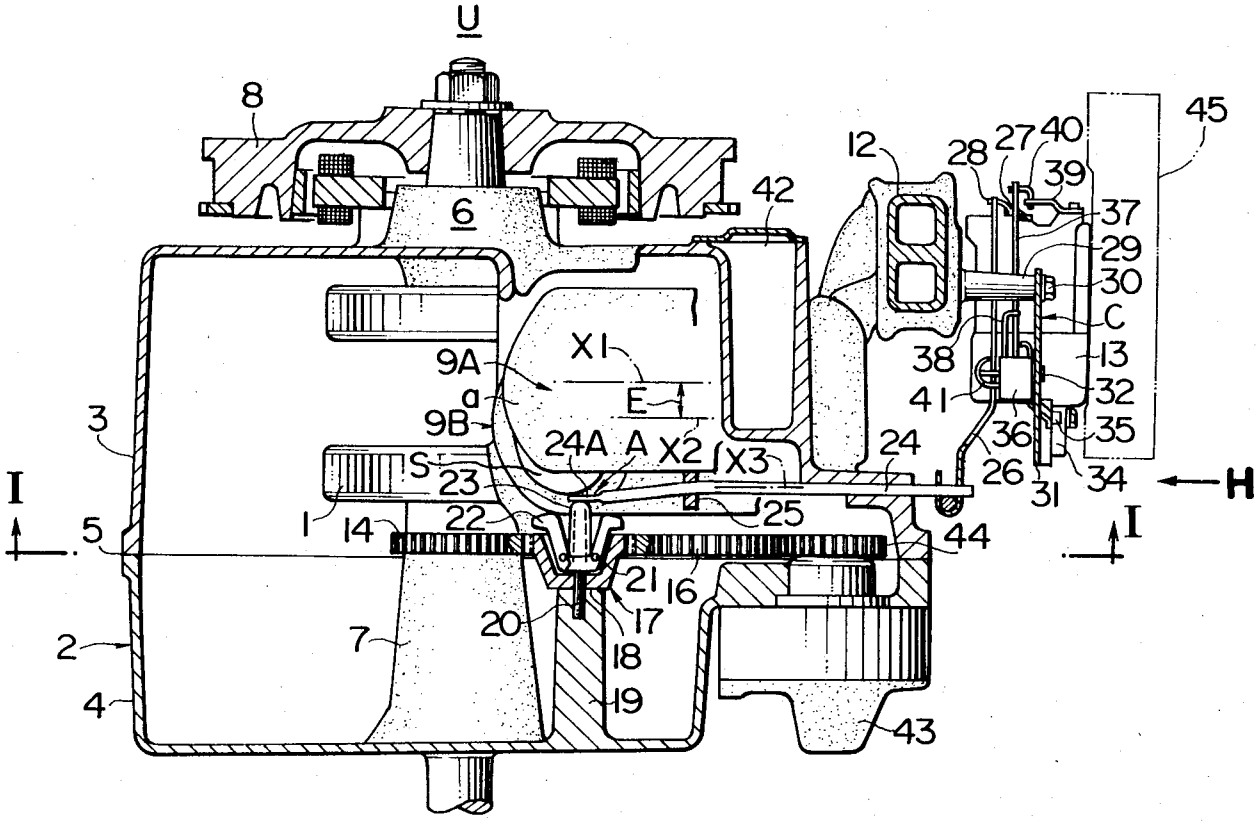
FIG. 2 is a cross-sectional view taken along the line II—II of FIG. 1.

A crankcase 2 has a first casing 3 on one side and a second casing 4 on the other side as shown in FIG. 2. The casings 3, 4 are coupled by bolts to form a single case with their contact surfaces 5 being aligned with each other. A first bearing portion 6 is formed integrally with the first casing 3, whereas a second bearing portion 7 is formed integrally with the second casing 4. The above-described crankshaft 1 is rotatably supported through the bearing portions 6, 7. One end portion of the crankshaft 1 extends from the crankcase 2 and is provided with a magnet wheel 8.

As shown in FIG. 1, a pair of cylinders 9A, 9B are formed integrally with the first casing 3 to form a V-shape. Each of the cylinders 9A and 9B is provided on its head side with a cylinder head 11 having a cylinder head cover 10. An intake manifold is adapted to bridge both the cylinder heads 11, 11, and a carbureter 13 is mounted at a midportion of the intake manifold 12. In the preferred embodiment, in view of the fact that the engine is of the vertical type, the carbureter 13 is of the side draft type for branching the intake air in a horizontal direction, which is inexpensive.

A cylinder skirt portion a of each of the cylinders 9A and 9B extends inwardly of the first casing 3 of the crankcase 2 in an integral manner. The cylinders 9A and 9B have centerlines X1 and X2 which are offset a distance E in an axial direction of the crankshaft 1 as shown in FIG. 2.

A crank gear 14 is disposed on the crankshaft 1 at a midportion of the casings 3 and 4, i.e., a position corresponding to the contact surface 5. Engaged with the crank gear 14 is a cam gear 16 provided on a cam shaft 15 disposed above the crankshaft 1 (FIG. 1). As shown in FIG. 2, the cam gear 16 engages on one side with a pump drive gear 44 for a water pump 43 and on the other side with a governor gear 18 of a governor device 17.

As shown in FIG. 2, the governor gear 18 is rotatably supported through a gear support shaft 20 to a gear support boss 19 extending integrally from the second casing 4 inwardly. The governor gear 18 is provided with a weight pin 21 with a governor weight 22 which may open and close. The governor weight 22 opens in response to the increase of the engine rpm, so that a governor sleeve 23 is advanced in the upward direction (in FIG. 2).

A governor lever shaft 24 are formed generally in an angularly bent form as shown in FIG. 1. When a pressure receiving flat portion provided at one end of the shaft 24 is pushed by the governor sleeve 23 shown in FIG. 2, the governor lever shaft 24 is rotated about its centerline X3. It is to be noted that a rotational speed transmission system A for transmitting a rotational speed of the governor gear 18 to the governor lever shaft 24 is provided on one side of the cylinder skirt portion a of one cylinder 9A of the cylinders 9A and 9B, offset opposite to the cam gear 16 engaging with the crank gear 14.

In other words, on one side of the cam gear 16 of the cylinder 9A, there is a space A corresponding to the offset distance E between the centerlines X1 and X2, and corresponding to the space S, the rotational speed transmission system A composed of the governor weight 22, governor sleeve 23 and governor lever shaft 24 is disposed.

The governor lever shaft 24 is disposed with its rotational center axis X3 perpendicular to the crankshaft 1 in FIG. 2 (i.e., parallel to the cylinder 9A), and perpendicular to the intake manifold 12 in FIG. 1. The governor lever shaft 24 is rotatably supported about a shaft support projection 25 extending from an outer periphery of the cylinder 9A.

When the governor sleeve 23 is advanced in the upward direction (FIG. 2) in response to the increase of the engine rpm, the pressure receiving portion 24A of the governor lever shaft 24 is also rotated about the rotational center axis X3 to be brought into contact with the cylinder 9A. Thus, the outer surface of the outer wall of the cylinder 9A serves as a positional stop for limiting the rotation of the governor lever shaft 24.

In the V-type internal combustion engine shown in the preferred embodiment, one end portion of the governor lever shaft 24 is disposed between the V-bank defined by the cylinders 9A and 9B as shown in FIGS. 1 and 2, and a governor lever 26 that constitutes a part of an intake air control mechanism C is connected to the end portion of the governor lever shaft 24.

The governor lever 26 is disposed in a space above the intake manifold 12 and on one side of the carbureter 13 as shown in FIG. 1. A throttle cooperation rod 28 is connected between the distal end of the governor lever 26 and a throttle lever 27 of the carbureter 13 as best shown in FIG. 3.

As shown in FIG. 1, two panel support bosses 29, 29 are formed integrally with and extended from an upper portion of the intake manifold. A control panel 31 is fixed to the panel support bosses 29, 29 by fastening members 30. The control panel 31 is disposed in a space corresponding to one side of the carbureter 13 and above (in FIG. 1) the intake manifold 12. The control panel 31 is remote from and parallel to the intake manifold 12 in the direction parallel to the crankshaft 1.

Figure 3:
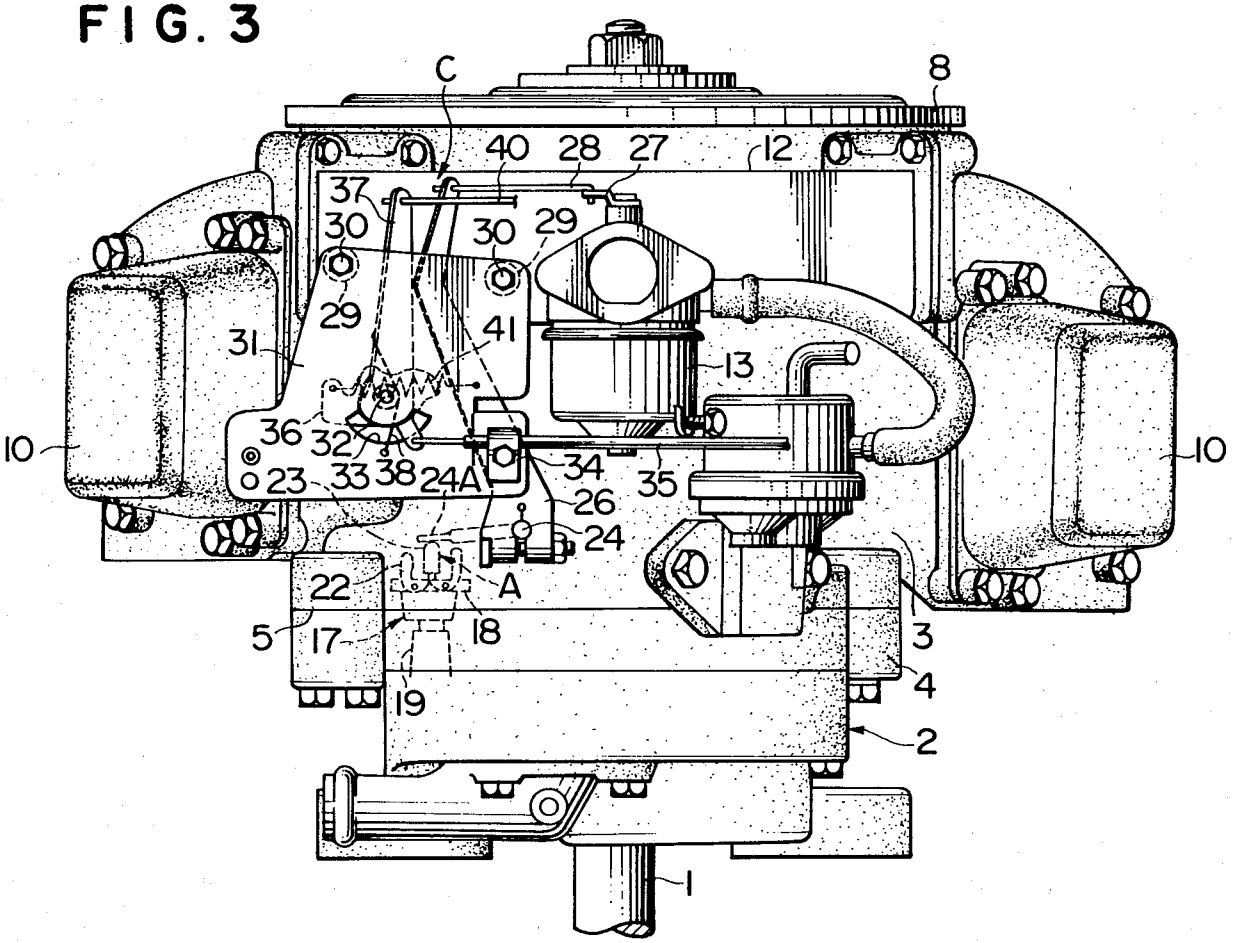
FIG. 3 is a perspective view as viewed in a direction H shown in FIG. 2.

As shown in FIG. 3, an arm support shaft 32 is fastened, by press-fitting, to a central portion of the control panel 31 and is extended downwardly (toward the crankcase 2). Also, an arm through-hole 33 of arcuate slot concentric with an upper end of the arm support shaft 32 is formed in the control panel 31. At one end of the control panel 31, an outer portion of a throttle wire 35 is fixed by a wire fastening member 34.

About the arm support shaft 32 provided in the control panel 31, there are rotatably provided two arms, that is, a relatively short throttle arm 36 and a relatively long choke arm 37. The throttle arm 36 has three bent pieces each extending form its central portion in three different directions. One of the bent pieces extends through the arm through-hole 33 to the outside of the control panel 31. The exposed end thereof is connected to an inner portion of the throttle wire 35. Another one of the three bent pieces is bent back in a U-shaped as shown in FIG. 1. A governor spring 41 is connected between a distal end of the bent piece and the above-described governor lever 26. The other of the bent pieces serves as a member for cooperating with the choke arm 37 as shown in FIG. 3. Incidentally, reference numeral 38 denotes a choke lever return spring which is provided around the arm support shaft 32.

A choke operation rod 40 is connected between an end of the choke arm 37 and a choke lever 39 of the carbureter 13. The intake control mechanism of the choke operation type is thus constructed. In particular, it should be noted that the intake control mechanism is disposed in the vicinity of the carbureter 13.

An air cleaner 45 is in fluid communication with the carbureter 13 as shown in FIG. 13.

With such an arrangement, as best shown in FIG. 2, the rotational speed transmission system A for transmitting the rotational speed of the governor gear 18 to the governor shaft 24 is placed to utilize the space S on one side of the cylinder skirt portion a of the cylinder 9A, of the cylinders 9A and 9B, offset to the opposite side to the cam gear 16 meshing with the crank gear 14. Accordingly, the engine length in the axial direction of the crankshaft 1 may be shortened, and the V-type internal combustion engine made more compact.

Further, as there is no necessity to provide an independent governor chamber on one side of the crankcase 2 as in the prior art, the structure of the crankcase 2 is simplified and the number of the mechanical parts reduced, which leads to a reduction in manufacture cost.

Also, since the above-described rotational speed transmission system A is disposed in the space S on one side of the cylinder skirt portion a, and the governor lever shaft 24 is extended from the crankcase 2, one end of the governor lever shaft 24 may be arranged in correspondence with the interior of the V-bank defined by the cylinders 9A and 9B. Thus, the cooperating system between the governor lever shaft 24 and the carbureter 13, in particular, the governor lever 26 may be shortened in length, thereby stabilize the function of the governor.

In this case, the direction the governor lever shaft 24 extends may be modified to run parallel to the right cylinder 9B (in FIG. 1), or alternatively parallel to the intake manifold 12.

As shown in FIG. 2, the governor weight 22 is disposed on one side of the cylinder 9A, and its location is remote from the bottom wall (FIG. 2) and the right wall (FIG. 2) of the crankcase. Therefore, in any case of the horizontal type in which the bottom wall (FIG. 2) is on the engine mount side and the vertical type in which the right wall (FIG. 2) is on the engine mount side, the governor weight 22 is located above the oil surface. Thus, in the case where the oil is held at a normal level, weight is not adversely affected and the operation of the governor weight. Thus, the operational sensitivity of the governor is ensured, and there is no fear that an oil temperature increase will occur due to the rotation of the governor weight 22.

In the vertical type shown in the preferred embodiment, since the governor device 17 is located below the cylinder skirt portion a, even if the governor weight 22 is be dipped into the oil due to the inclination of the engine to splash the oil, the cylinder skirt portion a serves as a protection wall, to avoid oil rise to the cylinder 9A interior and the invasion of oil mists into breezer chamber 42.

In the preferred embodiment, the cylinder 9A is used as the positional stop for the governor lever shaft 24. However, a positional stop may be formed by modifying the shaft support projection 25, or alternatively may be formed by providing a stop member for the projected end of the governor lever shaft 24 outside the engine.

Furthermore, it is possible to face the governor rotational speed transmission system in the opposite direction to that shown in FIG. 2, by providing a support boss for supporting the gear support shaft 20 to the cylinder skirt portion a.

Although in the preferred embodiment, the crankcase 2 has the coupling surface intersecting with the crankshaft 1 direction, a crankcase that is divided by the coupling surface including the center axis of the crankshaft 1 may be used.

In the preferred embodiment, the single intake manifold 12 is adapted to bridge the cylinder heads 11 in the V-bank defined between the cylinders 9A and 9B arranged in the V-shape on the crankcase 2. The carbureter 13 is in fluid communication with the intake manifold 12, and one end portion of the governor lever shaft 24 is within the crankcase 2 in the interior of the V-bank. The intake control mechanism C for controlling the carbureter in cooperation with end portion is disposed in the vicinity of the carbureter 13. Therefore, not only the governor lever 26 but also the throttle rod 28 may be a simplified shape like flat and short plates. With this feature, the intake control mechanism is not subjected to an adverse effect due to vibrations of the engine. Thus, the governor performance may be stabilized cost reduced. It is unnecessary detour the governor lever 26 around the cylinder, as required in the prior art.

In the preferred embodiment, the governor lever shaft 24 extends from the interior of the V-bank, so that the intake control mechanism C composed of the governor lever 26, throttle arm 36, choke arm 37 and the like may be disposed in the space defined between the intake manifold 12 and the carbureter 13. Thus, the intake control mechanism is located remotely from the other auxiliary mechanism making the design of the arrangement of the mechanisms easier.

It is apparent that the above-described throttle wire 35 is not limited to that shown in FIG. 3. The direction of the throttle wire may be opposite to that indicated by the two-dot-and-dash lines in FIG. 1 in the preferred embodiment. It is possible to utilize a throttle actuating lever (not shown). This improves the engine mounting.

If the engine is of the vertical type as in the preferred embodiment, an inexpensive carbureter 13 of the side draft type may be used. If the control panel 31 is fixed to one side of the carbureter 13, that is, to the intake manifold 12, the positional relation between the control panel 31 and the carbureter 13 may be made more precise improving the assembly accuracy of the intake control mechanism C further ensuring the stabilization of the operation of the intake control mechanism.

If the control panel 31 is fixed to the intake manifold, the control panel 31 is matched with the carbureter 13 as a vibratory system, thereby supressing vibration. If the control panel 31 is disposed within the V-bank, since the V-bank occupies a relatively large space in the engine, assembly and disassembly for the intake control mechanism is facilitated.

We claim:

1. A V-type internal combustion engine comprising: a crankcase; a crankshaft having a central axis and supported in said crankcase; governor means for representing a rotational speed of the engine, said governor means being located within said crankcase; cylinders each including a cylinder skirt portion projecting into said crankcase, said cylinders being arranged in a V-shape and having center axes offset from each other in a direction along said crankshaft central axis; and a rotational speed transmission system for transmitting the rotational speed of a governor gear to a governor lever shaft, said rotational speed transmission system engaging a rearward side of the cylinder skirt portion of a cylinder spaced forward from a rearmost cylinder as viewed along the crankshaft central axis.

2. An engine according to claim 1 further comprising means for limiting a rotation of said governor lever shaft, said limiting means comprising said cylinder skirt portion.

3. An engine according to claim 1 wherein said crankshaft central axis lies in a vertical direction.

4. An engine according to claim 2, wherein said crankshaft is directed in a vertical direction.

5. An engine according to claim 1 wherein a single intake manifold is provided to bridge cylinder heads of said cylinders in a V-bank defined between the cylinders, a carburetor is in fluid communication with said intake manifold, one end of said governor lever shaft is disposed in an interior of said V-bank, and an intake control mechanism for controlling the carburetor in cooperation with said one end of said governor lever shaft is disposed in the vicinity of said carburetor.

6. An engine according to claim 5 wherein said intake control mechanism is disposed in the interior of said V-bank.

7. An engine according to claim 5 wherein said crankshaft central axis lies in a vertical direction and carburetor is of the side draft type.

8. An engine according to claim 6, wherein said crankshaft central axis lies in a vertical direction and said carburetor is of the side draft type.

* * * * *